US005261479A

United States Patent [19]

Kruse et al.

[11] Patent Number: 5,261,479

[45] Date of Patent: Nov. 16, 1993

[54] MOLDING MACHINE WITH PATTERN VENTING

[75] Inventors: Ernst O. Kruse, Randegg; Kurt Fischer, Schaffhausen, both of Switzerland

[73] Assignee: Georg Fischer AG, Schaffhausen, Switzerland

[21] Appl. No.: 962,137

[22] Filed: Oct. 16, 1992

[30] Foreign Application Priority Data

Oct. 17, 1991 [CH] Switzerland ..... 03-044/91-5

[51] Int. Cl.[5] ..... B22C 7/04; B22C 15/00

[52] U.S. Cl. ..... 164/169; 164/238; 164/239; 164/410

[58] Field of Search ..... 164/169, 241, 242, 243, 164/239, 240, 235, 237, 238, 160.1, 160.2, 410

[56] References Cited

U.S. PATENT DOCUMENTS 3,293,703 12/1966 Taccone ..... 164/160.1
4,230,172 10/1980 Uzaki et al. ..... 164/195 X
4,620,584 11/1986 Witt ..... 164/195 X

FOREIGN PATENT DOCUMENTS 3813755 11/1989 Fed. Rep. of Germany ..... 164/241
55-147461 11/1980 Japan ..... 164/169
56-14052 2/1981 Japan ..... 164/169
56-39147 4/1981 Japan ..... 164/195
1530325 12/1989 U.S.S.R. ..... 164/169

*Primary Examiner*—J. Reed Batten, Jr.
*Attorney, Agent, or Firm*—Bachman & LaPointe

[57] ABSTRACT

An apparatus for producing sand mold employing compressed air comprises a sand molding apparatus for use in making sand molds by employing compressed air. The apparatus includes, in the preferred embodiment, a pattern plate carrier having a top surface for supporting a pattern plate thereon. A molding box is positioned on the top surface of the pattern plate carrier and surrounds the pattern plate so as to define between the pattern plate and the interior surface of the molding box a peripheral area on the top surface of the carrier. Vents are provided on either the peripheral area define above or the pattern plate or both and extend around the pattern plate for allowing compressed air which is injected into the molding box during compression of the molding sand to escape on the pattern side of the molding box. A chamber is defined within the carrier beneath the pattern plate and is communicated with the vent structure by means of bores. The chamber is thereafter communicated with a conduit for removing the compressed air to a remote location.

4 Claims, 1 Drawing Sheet

MOLDING MACHINE WITH PATTERN VENTING

BACKGROUND OF THE INVENTION

The present invention relates to sand molding apparatus for air-pressurized compaction processes and, more particularly, a sand molding apparatus for compacting molding sand with compressed air wherein the compressed air vented from the pattern side of the molding box is collected and communicated to a remote location.

In sand molding processes used to produce sand molds for casting molten metal, compressed air is made to flow vertically from the top of the sand located in the sand mold to the bottom. In order to obtain better compaction of the sand on the pattern in the molding apparatus, particularly in the marginal zones along the interior wall of the molding box, the compressed air flowing in on the upper side of the molding box and vertically down through the molding sand must be able to escape on the pattern side of the molding box. A typical arrangement is shown for example in German Patentschrift 26 08 740. One of the disadvantages of an apparatus as aforesaid resides in the fact that the compressed air flowing out of the molding box produces loud hissing noises and causes ultrafine silica dust to be spread about the facility for producing the sand molds. As the pattern plate is normally above floor level during the aerating operation, personnel within the facility are endangered by the noise and dust.

Naturally, it would be highly desirable to provide a sand molding apparatus which would allow for the collection of the compressed air escaping from the molding box on the pattern side thereof and transporting the air to a remote location thereby eliminating the deleterious affects of the ultrafine silica dust and excessive noise on the personnel within the facility.

Accordingly, it is the principal object of the present invention to provide an apparatus as aforesaid which allows for the collection and removal of the compressed gas escaping from the molding box on the pattern plate side thereof.

It is a further object of the present invention to provide an apparatus as aforesaid which includes a pattern plate carrier for supporting a pattern plate which together define a chamber for collecting the compressed air escaping from the pattern side of the molding box.

It is a still further object of the present invention to provide conduit means for communicating the chamber of the apparatus as aforesaid with a location remote from the facility.

It is a still further object of the present invention to provide an apparatus as aforesaid which is simple in structure and efficient in operation.

Further objects and advantages of the present invention will appear hereinbelow.

SUMMARY OF THE INVENTION

In accordance with the present invention the foregoing objects and advantages are readily obtained.

The present invention relates to a sand molding apparatus for use in making sand molds by employing compressed air. The apparatus includes, in the preferred embodiment, a pattern plate carrier having a top surface for supporting a pattern plate thereon. A molding box is positioned on the top surface of the pattern plate carrier and surrounds the pattern plate so as to define between the pattern plate and the interior surface of the molding box a peripheral area on the top surface of the carrier. Vents are provided on either the peripheral area define above or the pattern plate or both and extend around the pattern plate for allowing compressed air which is injected into the molding box during compression of the molding sand to escape on the pattern side of the molding box. A chamber is defined within the carrier beneath the pattern plate and is communicated with the vent structure by means of bores. The chamber is thereafter communicated with a conduit for removing the compressed air to a remote location.

In accordance with the preferred embodiment of the present invention a bracket member extends from the conduit to the molding apparatus for securing the conduit to the molding apparatus for prohibiting twisting of the molding table upon which the pattern plate carrier rests.

BRIEF DESCRIPTION OF THE DRAWINGS

The present invention will be explained in detail hereinbelow with reference to the following drawings wherein.

DETAILED DESCRIPTION

Figure 1:
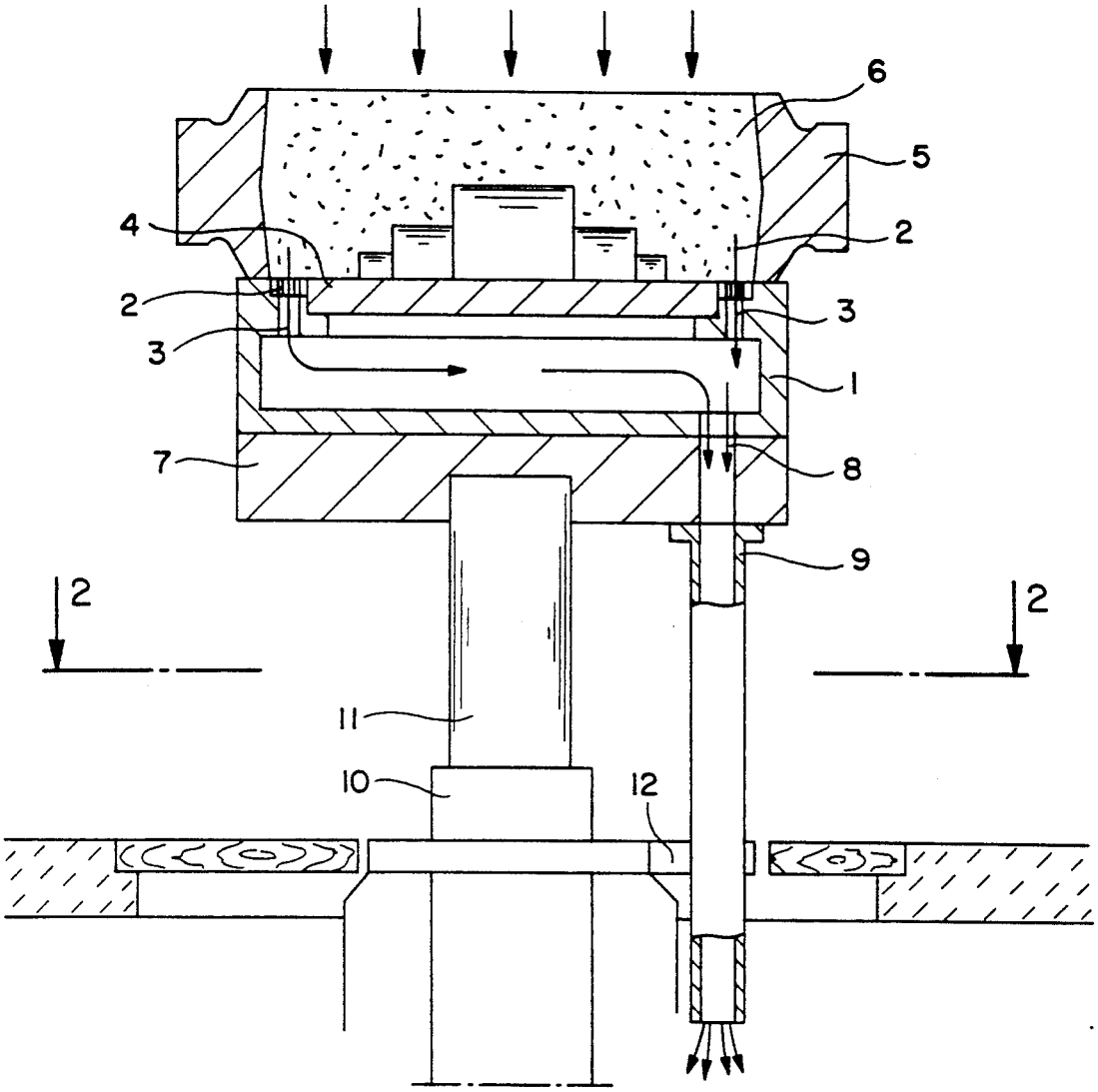
FIG. 1 is a partial side sectional view of a molding apparatus in accordance with the present invention for collecting and carrying away compressed air from a compressed air molding process.

With reference to the figures, a molding apparatus 10 is illustrated and comprises a pattern plate carrier 12 for supporting a pattern plate 14 thereon. A molding box 16 is supported on the top surface 18 of the pattern plate carrier and defines therewith a molding space 20. A pattern 22 is located on the pattern plate 14 within the molding space 20. Molding sand 24 is fed to the molding space 20 in any known manner and thereafter the sand of a top surface is subjected, in a known manner to a flow of compressed air for compacting the sand 24 within the molding space 20 about the pattern 22 on the pattern plate 14.

In order for the air flowing through the molding sand 24 to escape from the molding space 20 vents 26 are provided. As illustrated in FIG. 1, the vents 26 are shown to be located in the top surface of the pattern plate carrier 12. It should be appreciated that vents could also be employed directly in the pattern plate 14 in lieu of the vents in the carrier or in addition thereto.

In accordance with the present invention the pattern plate carrier 12 defines below the pattern plate 14 a chamber 28 for receiving the compressed air escaping from the pattern side of the molding box 16 through the vents 26 and bore 30 which communicates the vents 26 with the chamber 28. The pattern plate carrier 12 rests on the mold table 32 of the molding apparatus. The mold table 32 is moved up and down by ram 52 of actuator 50. The molding table 32 is provided with at least one bore 34 which communicates with chamber 28 via a passage 36 provided in the bottom surface 38 of the pattern plate carrier 12.

A Venting tube 40 communicates with and is in axial alignment with bore 34 provided in the molding table 32. Venting tube or conduit 40 communicates air from the chamber 28 to a remote location below the floor of the facility. By virtue of the air leaving below the floor level of the facility the noise and dust nuisance described above is avoided. In a preferred embodiment of the present invention the conduit 40 may be communicated by hose with a de-dusting facility not shown.

Figure 2:
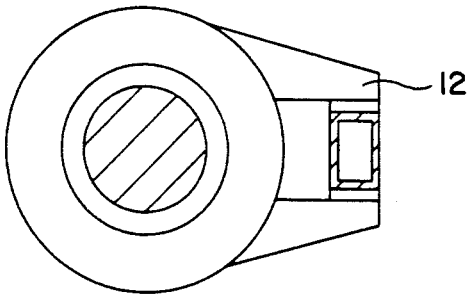
FIG. 2 is a sectional view of the apparatus of FIG. 1 taken along line A-B.
Figure 1:
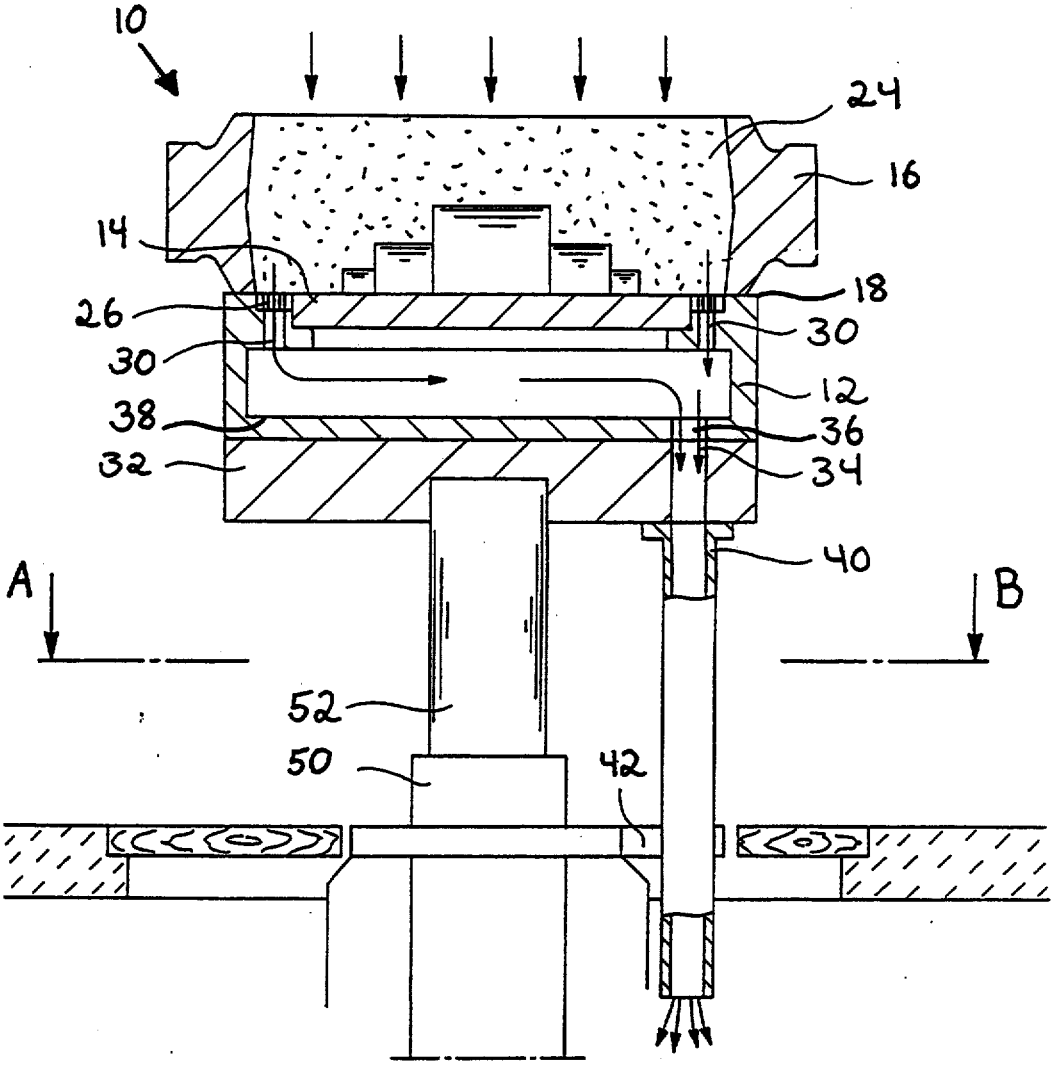
Figure 2:
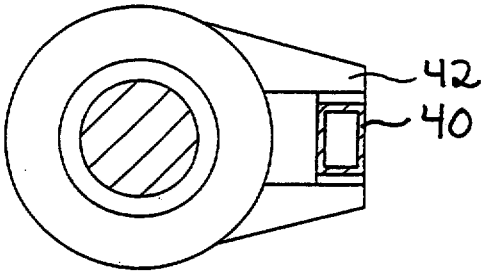

In accordance with a further feature of the present invention, as can best be seen in FIG. 2, a bracket arrangement 42 extends from the conduit 40 to the molding apparatus 10 or other structure, particularly the base thereof, for securing the venting tube 40 to the molding apparatus 10. In this manner the conduit or venting tube 40 is used in conjunction with the brackets 42 to prohibit any twisting motion of the molding table.

The apparatus of the present invention provides a simple and economic manner for removing the dust laden compressed air from the sand molding apparatus used for air pressurized compaction processes thereby avoiding the harmful affects of dust and noise on personnel within the facility for producing the sand molds.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

We claim:

1. In a facility for producing sand molds, a sand molding apparatus for compacting molding sand with compressed air having a pattern plate and a molding box which together define a molding space wherein vent means are provided on the pattern plate for allowing the compressed air to escape the molding space on the pattern side of the molding box, the improvement comprises chamber means defined beneath said pattern plate for receiving the compressed air escaping from the pattern side of the molding box through the vent means, conduit means communicating the chamber means with a location remote from the sand molding apparatus and bracket means extending from the conduit means to the sand molding apparatus for securing the conduit means to the sand molding apparatus for prohibiting twisting of the pattern plate.

2. A sand molding apparatus for use in making sand molds comprises a pattern plate carrier having a top surface, a pattern plate supported on the top surface of the carrier, a molding box positioned on the top surface of the carrier and surrounding the pattern plate thereby defining between the pattern plate and the interior surface of the molding box a peripheral area on the top surface of the carrier, vent means provided on at least one of the peripheral area and the pattern plate and extending around the pattern plate for allowing compressed air injected into the molding box to escape below the pattern plate, chamber means defined within the carrier beneath the pattern plate and top surface of the carrier to receive the escaped compressed air, bore means connecting the vent means with the chamber means, conduit means communicating the chamber means with a location remote from the sand molding apparatus and bracket means extending from the conduit means to the sand molding apparatus for securing the conduit means to the sand molding apparatus for prohibiting twisting of the pattern plate carrier.

3. An apparatus according to claim 2 wherein the pattern plate carrier lies on a molding table of the sand molding apparatus and the conduit means includes at least one bore in the molding table aligned with at least one bore in a bottom surface of the pattern plate carrier for communicating the chamber means with the remote location.

4. An apparatus according to claim 3 including means for connecting the venting tube to a de-dusting installation.

* * * * *

UNITED STATES PATENT AND TRADEMARK OFFICE

CERTIFICATE OF CORRECTION

PATENT NO. : 5,261,479

DATED : November 16, 1993

INVENTOR(S) : Ernst Otto Kruse et al.

It is certified that error appears in the above-identified patent and that said Letters Patent is hereby corrected as shown below:

The title page, should be deleted to be replaced with the attached title page. The drawing sheet consisting of Figs. 1-2, should be deleted to be replaced with the drawing sheet consisting of Figs. 1-2, as shown on the attached page.

Signed and Sealed this

First Day of October, 1996

Bruce Lehman

*Attest:*

BRUCE LEHMAN

*Attesting Officer*

*Commissioner of Patents and Trademarks*

United States Patent [19]

Kruse et al.

[11] Patent Number: 5,261,479

[45] Date of Patent: Nov. 16, 1993

[54] MOLDING MACHINE WITH PATTERN VENTING

[75] Inventors: Ernst O. Kruse, Randegg; Kurt Fischer, Schaffhausen, both of Switzerland

[73] Assignee: Georg Fischer AG, Schaffhausen, Switzerland

[21] Appl. No.: 962,137

[22] Filed: Oct. 16, 1992

[30] Foreign Application Priority Data

Oct. 17, 1991 [CH] Switzerland ..... 03-044/91-5

[51] Int. Cl.[5] ..... B22C 7/04; B22C 15/00

[52] U.S. Cl. ..... 164/169; 164/238; 164/239; 164/410

[58] Field of Search ..... 164/169, 241, 242, 243, 164/239, 240, 235, 237, 238, 160.1, 160.2, 410

[56] References Cited

U.S. PATENT DOCUMENTS

| | | | |
|---|---|---|---|
| 3,293,703 | 12/1966 | Taccone | 164/160.1 |
| 4,230,172 | 10/1980 | Uzaki et al. | 164/195 X |
| 4,620,584 | 11/1986 | Witt | 164/195 X |

FOREIGN PATENT DOCUMENTS

| | | | |
|---|---|---|---|
| 3813755 | 11/1989 | Fed. Rep. of Germany | 164/241 |
| 55-147461 | 11/1980 | Japan | 164/169 |
| 56-14052 | 2/1981 | Japan | 164/169 |
| 56-39147 | 4/1981 | Japan | 164/195 |
| 1530325 | 12/1989 | U.S.S.R. | 164/169 |

*Primary Examiner*—J. Reed Batten, Jr.

*Attorney, Agent, or Firm*—Bachman & LaPointe

[57] ABSTRACT

An apparatus for producing sand mold employing compressed air comprises a sand molding apparatus for use in making sand molds by employing compressed air. The apparatus includes, in the preferred embodiment, a pattern plate carrier having a top surface for supporting a pattern plate thereon. A molding box is positioned on the top surface of the pattern plate carrier and surrounds the pattern plate so as to define between the pattern plate and the interior surface of the molding box a peripheral area on the top surface of the carrier. Vents are provided on either the peripheral area define above or the pattern plate or both and extend around the pattern plate for allowing compressed air which is injected into the molding box during compression of the molding sand to escape on the pattern side of the molding box. A chamber is defined within the carrier beneath the pattern plate and is communicated with the vent structure by means of bores. The chamber is thereafter communicated with a conduit for removing the compressed air to a remote location.

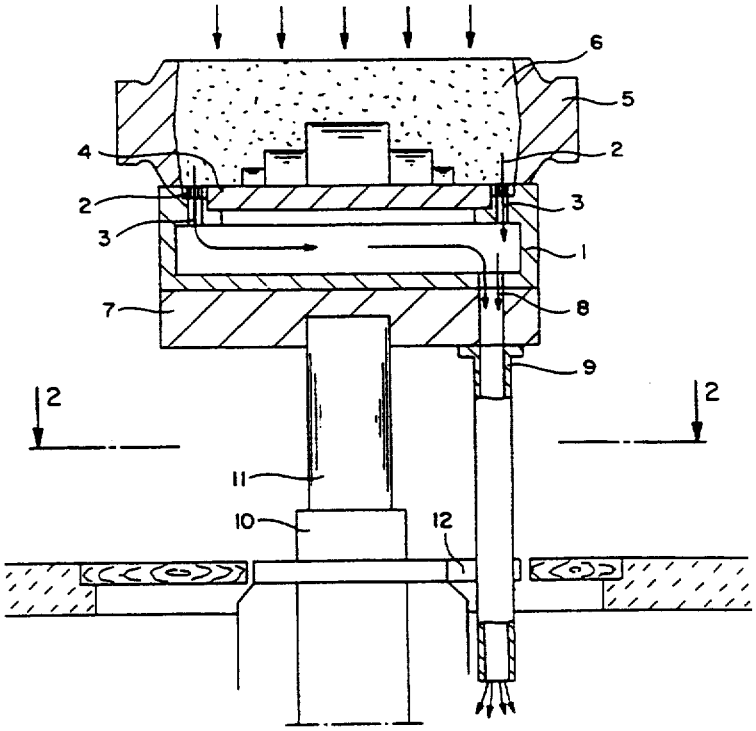

4 Claims, 1 Drawing Sheet